US006760963B2

(12) United States Patent
Wade

(10) Patent No.: US 6,760,963 B2
(45) Date of Patent: Jul. 13, 2004

(54) DUCTILE MATERIAL LANCE JOINER

(76) Inventor: Colin Maxwell Wade, 12 Boundary Road Red Lodge, Bury St Edmunds, Suffolk (GB), IP28 8JQ ( * ) Notice: Subject to any disclaimer, the term of this patent is extended or adjusted under 35 U.S.C. 154(b) by 86 days.

(21) Appl. No.: 10/182,595

(22) PCT Filed: Nov. 22, 2001

(86) PCT No.: PCT/GB01/05147

§ 371 (c)(1),
(2), (4) Date: Oct. 23, 2002

(87) PCT Pub. No.: WO02/43893

PCT Pub. Date: Jun. 6, 2002

(65) Prior Publication Data

US 2003/0188564 A1 Oct. 9, 2003

(30) Foreign Application Priority Data

Nov. 28, 2000 (GB) ..... 0029046

(51) Int. Cl.[7] ..... B23P 6/00

(52) U.S. Cl. ..... 29/402.03; 29/402.08; 29/432.1; 29/505; 29/521; 83/955

(58) Field of Search ..... 29/21.1, 402.01, 29/402.03, 402.08, 426.1, 432, 432.1, 434, 436, 505, 521, 798, 283.5, 243.5; 72/477; 83/955, 694

(56) References Cited

U.S. PATENT DOCUMENTS 4,658,502 A * 4/1987 Eckold et al. ..... 29/798
4,757,609 A * 7/1988 Sawdon ..... 29/798
5,549,025 A * 8/1996 Muller ..... 83/694
5,581,860 A 12/1996 Sawdon ..... 29/243.5
6,612,007 B1 * 9/2003 Wade ..... 29/243.5

FOREIGN PATENT DOCUMENTS

| | | |
|---|---|---|
| GB | 2123734 | 2/1984 |
| GB | 2189175 | 10/1987 |
| WO | 9520461 | 8/1995 |

OTHER PUBLICATIONS

UK Patent Office; Search Report Under Section 17; Apr. 18, 2001.

* cited by examiner

*Primary Examiner*—David P. Bryant
*Assistant Examiner*—Jermie E. Cozart
(74) *Attorney, Agent, or Firm*—Bourque & Associates, P.A.

(57) ABSTRACT

The present invention relates to a joiner for lance joining ductile materials, such as metal sheets, and in particular to a joiner including a die assembly and a punch assembly. The die assembly includes a die anvil and an anvil surface. There are at least two die blades around the anvil, the blades extending in a longitudinal direction, generally above and below opposite sides of the anvil surface to form a die aperture for the punch. Each blade is arranged to move away from the anvil to open up the aperture when ductile material is forced in the longitudinal direction into the aperture and against the anvil by the punch. Each blade has a cutting edge above the anvil facing towards the die aperture for cutting through the ductile material to make a lance joint when the material is forced into the aperture. The assembly also has at least one biasing means by which the blades are biased towards the anvil to constrict the aperture. Each blade can be removed from the anvil, rotated relative to the anvil surface about the longitudinal direction, and then returned to the anvil to present a different cutting edge above the anvil and facing towards the die aperture.

16 Claims, 5 Drawing Sheets

DUCTILE MATERIAL LANCE JOINER

TECHNICAL FIELD

The present invention relates to a joiner for lance joining ductile materials, such as metal sheets, and in particular to a joiner including a die assembly and a punch assembly.

BACKGROUND INFORMATION

It is known to join a plurality of sheets of ductile material by causing these to be deformed into an interlocking configuration in a local area. Such joins are made by ductile material joining tools comprising a die with an aperture that is opposite a punch assembly comprising a punch surrounded by a stripper mechanism. Layers of ductile material are sandwiched between the punch assembly and when the punch is pressed towards the aperture, material is drawn into the aperture. The material undergoes plastic deformation in the aperture to flow into a shape in which two or more layers are interlocked, for example by the forming of one layer around another layer.

The aperture has a base with an anvil having an anvil surface and at least two side walls formed from movable blades. The blades are generally transverse to the anvil surface and extend in the direction in which the die and punch are pressed together. The blades help define the local area, for example a circular, square or rectangular area, in which the deformation of the layers of sheet material takes place. Once the material has been drawn and flows into the aperture, the blades move away from each other in a radial direction as sheet material flows laterally. Some types of die blade pivot outwards about a pivot mechanism below the level of the anvil surface. The pivot mechanism has a pivot axis or pivot point below and laterally outside an edge of the anvil surface.

The outward movement of the blades is constrained by a die shield, which extends around the die held in a fixed relationship with the die. In many designs, the space taken up by the pivot mechanism and die shield tends to increase the size of the die, which is inconvenient when a die must be small, for example when used in confined circumstances such as making joins near corners of sheet metal.

A circular die and punch can be used to form a clinch joint in which sheet material is symmetrically deformed both axially and radially to form a leak-proof button, for example as disclosed in patent document U.S. Pat. No. 5,153,513. A square or rectangular die and punch can be used to form a trapezoidal clinch joint (also called a lance joint), in which the sheet material is cut through by the punch along a pair of parallel opposed lines, with the layers of sheet material deformed laterally outwards underneath each of the cuts, as disclosed in patent document GB 2,334,474. The present invention relates to a die and punch for forming a lance joint, and the terms "lance joiner" and "lance joint" will be used respectively for such clinching devices and clinch joints.

It is known in the prior art to include in the die some biasing means of biasing the die blade back towards the anvil surface after the drawing operation by the punch is completed. For this, a coil spring, leaf spring, or elastomeric o-ring can be provided., which may extend fully around the outside of the die blades. As the die blades move outwards to dilate the aperture, the spring or o-ring becomes stretched or compressed. When the joined sheet material is withdrawn from the aperture, the die blades return to their start position owing to the tension or compression in the spring or o-ring.

Because the spring or o-ring extends around the outside of the die blades, usually between the die blades and the surrounding die shield, lateral space must be provided for the spring or o-ring. Lateral clearance space can result in a die blade being dislodged from between the anvil and die shield, and being lost from the die, particularly if a spring or o-ring breaks. This is very inconvenient in a production environment, as any machine using the sheet metal joiner would then have to be stopped to repair or replace the faulty die. If the faulty die were not spotted immediately, a great deal of rework to joined fabrications might then be required.

The lifetime of a die is limited essentially by the die blades. The upper inward corner of the die blade must form a sharp edge of about 90°, but this will become dull with excessive use. When clinch joining hard metals, such as stainless steel, the lifetime of a die blade may be as short as 10,000 to 20,000 cycles. In order to maintain join quality, it is necessary to keep to a conservative schedule for changing die blades, which adds to manufacturing cost.

A rectangular or square die for lance joints inevitably has four corners around which a spring or o-ring must pass. These corners, even is somewhat rounded, are a source of wear on the biasing means. It can be very difficult to predict when a spring or o-ring may break, or need changing. A spring or o-ring may also become damaged by the corners when die blades are changed, and this makes failure of the biasing means more unpredictable.

A breakage of a spring or a die blade may not be noticed immediately in a production environment, and will result in faulty joins and/or damage to the work pieces being joined.

SUMMARY

It is an object of the present invention to provide a die, for a ductile material lance joiner, and also a ductile material lance joiner for lance joining two or more layers of ductile material, which addresses these issues.

Accordingly, the invention provides a die for a ductile sheet material lance joiner, comprising:

a) a die anvil, the anvil having an anvil surface;

b) at least two die blades around the anvil, the blades extending in a longitudinal direction, generally above and below opposite sides of the anvil surface and forming with the anvil surface a die aperture for a die punch, each die blade being arranged to move away from the anvil to open up the die aperture when ductile material is forced in the longitudinal direction into the die aperture and against the anvil by a die punch, and each die blade having a cutting edge above the anvil surface and facing towards the die aperture for cutting through ductile material to make a lance joint when said ductile material is forced into the die aperture; and c) at least one biasing means by which the die blades are biased towards the anvil to constrict the die aperture;

characterised in that each die blade can be removed from the anvil and then returned to the anvil in such a way that each die blade is essentially rotated relative to the anvil surface about the longitudinal direction to present a different cutting edge above the anvil surface and facing towards the die aperture.

Each die blade may therefore be provided with two cutting edges above the anvil, a first one of which at any one time faces in towards the die aperture, and a second one of which faces outwards from the die aperture. The first cutting edge can then be used until it becomes blunt, and the die removed from the anvil and rotated relative to the anvil surface about the longitudinal direction, and then returned to the anvil with the second cutting edge positioned so that this can be used as the cutting edge. This allows the lifetime of each die blade to be effectively doubled.

The die blades may move by sliding or pivoting, for example on a shoulder extending laterally away from and below the anvil surface, in order to open up the die aperture. If the die blade pivots, then the pivot point is preferably below and laterally outside the anvil surface.

In a preferred embodiment of the invention, there is for each die blade a pivot recess in the anvil. Each die blade then has a seat that is shaped to match the pivot recess so that when the die blade is seated in the pivot recess, each die blade can rotate outwards from the anvil to open up the die aperture when ductile material is forced in the longitudinal direction into the die aperture and against the anvil by a die punch. Such a pivot recess helps spread the load on the die blade imparted by the die punch. A rotational pivot also provides a low friction seat, even without lubricant, that essentially does not wear over the lifetime of the die blade.

The anvil may be rectangular or square with a pair of die blades on opposite sides of the anvil, and a pair of opposite parallel sides that extend between the die blades. The biasing means can then extend around the die blades and this pair of opposite parallel sides. An advantage of this arrangement, when the die blades may be removed form the anvil along a transverse direction to the longitudinal direction, is that the biasing means helps to retain the die blades to the anvil.

Also according to the invention there is provided a die tool for lance joining two or more layers of ductile material, comprising a base plate, a recess in the base plate, and a die, the die being seated in the recess, wherein the die is according to the invention, and the recess serves as a die blade shield to limit the movement of the die blades away from the anvil.

The invention also provides a ductile material joiner for lance joining two or more layers of ductile material, comprising a punch and a die with a die aperture matching the punch, wherein the die is according to the invention.

The invention further provides a method of servicing a die for a ductile material lance joiner, the die being according to the invention, wherein the method comprises the steps of:

i) removing one or more of the die blades from the anvil;

ii) returning the die blade to the anvil in such a way that each removed die blade is essentially rotated relative to the anvil surface about the longitudinal direction to present a different cutting edge above the anvil surface and facing towards the die aperture.

One way of accomplishing the relative rotation of the die blade relative to the anvil surface is by removing the die blade from the anvil, rotating the die 180° about an axis passing through the die blade in a direction parallel to the longitudinal direction, and then returning the die blade to the anvil.

An alternative way of accomplishing the relative rotation of the die blade relative to the anvil surface is by removing a pair of opposite die blades from the anvil, and then without altering the orientation of the die blade relative to an axis passing through the die blade in a direction parallel to the longitudinal direction, returning each die blade to the anvil in the location originally occupied by the other die blade.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
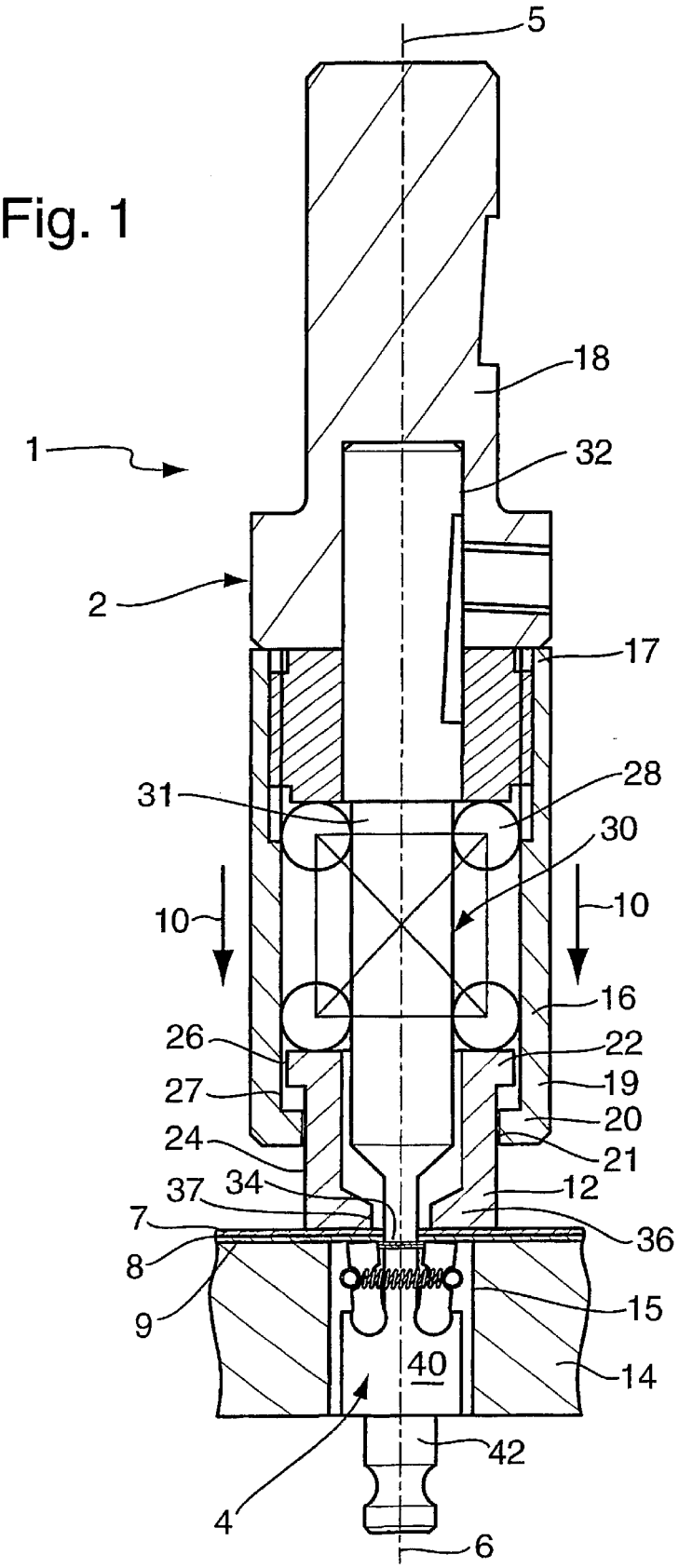
FIG. 1 is a partial cross-section view of a die according to the invention, seated in a base plate and with a punch, having a die body with a central anvil and pair of parallel die blades either side of the anvil that move apart while being used to form a lance joint in two sheets of ductile material.

FIG. 1 shows a first embodiment of a sheet metal clinch joiner 1 for forming a lance joint, comprising a punch assembly 2 and a die assembly 4. The punch assembly 2 and die assembly 4 are aligned along common axes 5,6. Between the punch assembly 2 and die assembly 4 are a pair of thin metal sheets 7,8 which are aligned transverse to the punch assembly and die axes 5,6. The sheets 7,8 are in contact along a common interface 9.

In a sheet material joining operation, the punch assembly 2 is brought towards the pair of sheets 7,8 along a longitudinal direction as indicated by movement arrows 10 until a forward hollow stripper tip 12 of the punch assembly 2 comes into contact with one of the metal sheets 7, thereby pressing the other metal sheet 8 against a base plate 14 surrounding the die assembly 4. The base 14 has a recess 15 in which the die assembly 4 is removably seated.

The punch assembly 2 has a main cylindrical housing 16 referred to herein as a stripper can. The part of the stripper can 16 away from the metal sheets 7,8 has an open end 17 plugged with a punch holder 18. The other end 19 of the stripper can 16 has a radially inwards directed lip 20 which terminates in a central circular aperture 21 from which the stripper tip 12 extends. The stripper tip 12 has an outwardly directed flange 22 inside the stripper can 16. An outer cylindrical surface 24 of the stripper tip 12 is a close sliding fit with the matching cylindrical aperture 21 of the stripper can lip 20. In addition, the stripper tip flange 22 has an outer cylindrical surface 26 which has a close sliding fit with an inner cylindrical surface 27 of the stripper can 16. The stripper tip 12 is therefore free to slide axially with respect to the stripper can 16 along the longitudinal direction 10.

The sliding fit of the stripper tip 12 within the stripper can 16 is limited in an outwards direction by contact between the stripper can lip 20 and the stripper tip flange 22. A coil spring 28, shown schematically in FIG. 1, is retained within the stripper can 16 between the punch holder 18 and the stripper tip flange 22. The coil spring 28 biases the stripper tip 12 outwards so that in a rest condition the stripper tip flange 22 remains in contact with the stripper can lip 20. The axial sliding movement of the stripper tip with respect to the stripper can is limited in an axially inwards direction by compression of the spring 28 against the punch holder 18.

A punch 30 is axially centered on the punch axis 5, and is set into a cylindrical recess 32 in the punch holder 18. The punch 30 has an upper cylindrically symmetric portion 31 that extends axially along the centre of the stripper can 16 into the stripper tip 12, where the punch 30 tapers down to a punch tip 34 with a rectangular cross-section. The stripper tip 12 terminates in a neck 36 with a rectangular inner surface 37 that has a clearance fit with the rectangular stripper tip 34.

When the punch assembly 2 is moved 10 down against the metal sheet 7 the stripper tip 12 comes first into contact with the metal sheet 7. Further movement 10 then causes the stripper tip 12 to slide axially with respect to the stripper can 16, with the result that the spring 28 begins to be compressed whilst the punch tip 34 continues with the motion 10 towards the metal sheet 7.

As this is happening, the base 14 plate and the die assembly 4 provides a restoring force against the other metal sheet 8. Most of the restoring force is provided through the die base plate 14.

Figure 2:
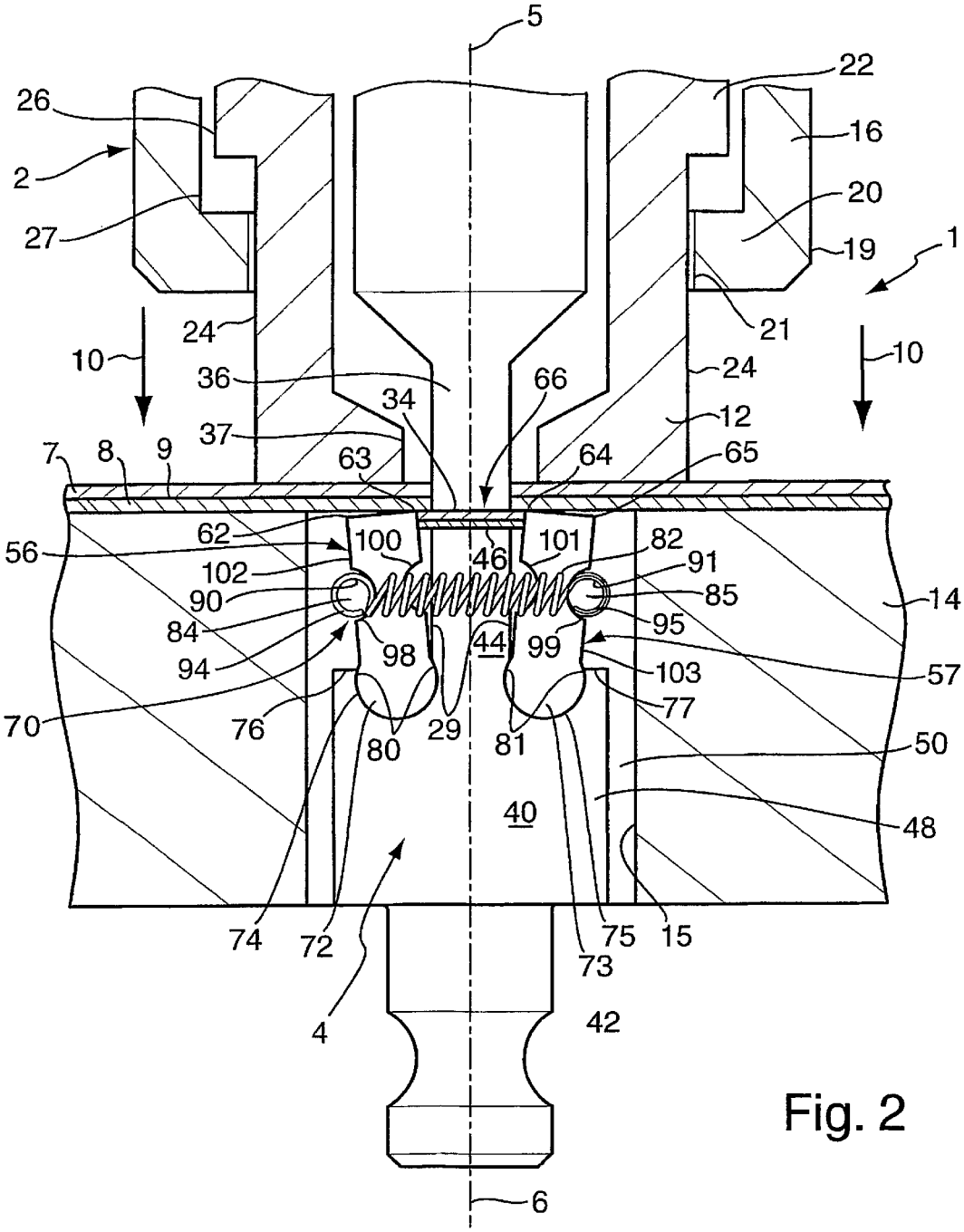
FIG. 2 is an enlarged partial cross section view of a part of FIG. 1, showing the die and spring biasing means used to bias the die blades towards the anvil.
Figure 3:
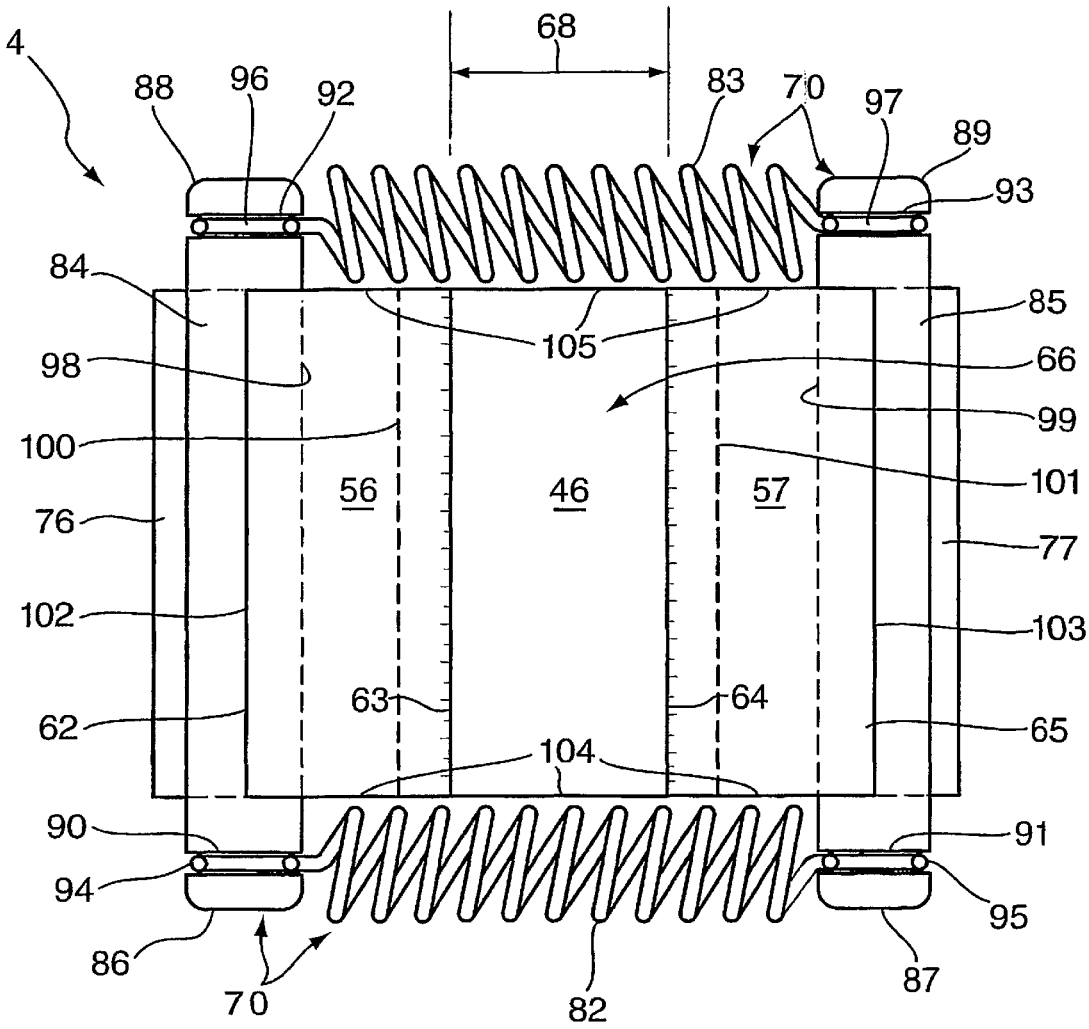
FIG. 3 is a top plan view of the die and spring biasing means of FIG. 1, with the pair of die blades closed against the anvil, and each die blade having a pair of parallel cutting edges, one of which adjacent the anvil has been worn through use.

As shown most clearly in FIGS. 2 and 3, the die assembly 4 has a unitary die body 40 which is rectangularly symmetric about the die axis 6. The die body 40 has at one end a lower stem 42 that in use is seated in a tool holder (not shown) to which the base plate 14 is also securely affixed. At the opposite end of the die body 40 is a die anvil 44 with a flat anvil surface 46. A die base portion 48 between the die stem 42 and die anvil 44 has a cross-section greater in extent than that of the die stem 42 and die anvil 44.

The base plate recess 15 extends around and is spaced from the die anvil 44 and die base portion 48 by a gap 50.

The gap 50 between the base plate 14 and the die anvil 44 is substantially filled by a pair of similar die blades 56,57.

Figure 4:
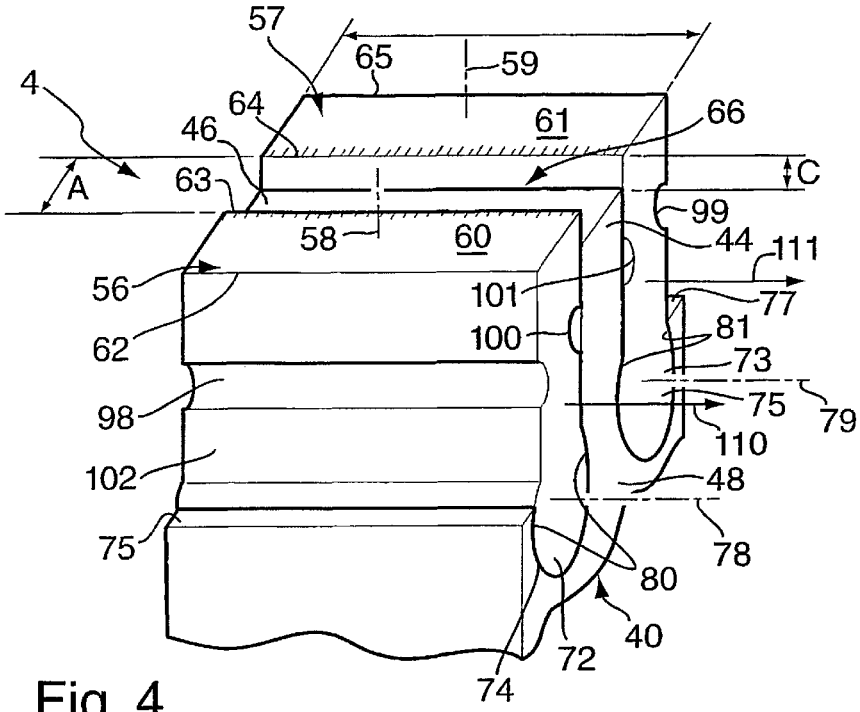
FIG. 4 is a perspective view of the die of FIG. 1, with the spring biasing means removed.

As seen best in FIG. 4, each die blade 56,57 has a rectangular symmetry about an axis 58,59 along the longitudinal direction 10. Each die blade 56,57 has a rectangular upper surface 60,61, with a pair of straight and parallel cutting edges 62,63; 64,65 along the long sides of the die blade upper surface 60,61. The die blades 56,57 are arranged either side of the die anvil 44, which has a similarly rectangular cross-section shape. Each die blade 56,57 presents just one of the cutting edges 62,63; 64,65 towards the anvil surface 46 at any one time.

Each die blade 56,57 extends longitudinally above and below the anvil surface 46 and forms with the anvil surface 46 a rectangular die aperture 66 for the punch tip 34. The separation between the blades 56,57 defines an aperture width 68, and the extension of the die blades 56,57 above the anvil surface 46 defines an aperture depth (C).

As will be explained in more detail below, the inward facing cutting edges serve to cut through ductile material 6,7 to make a lance joint when the ductile material is forced into the die aperture 66 along the longitudinal direction 10 by the punch tip 34.

Each die blade 56,57 has a die blade seat 72,73 at the opposite end from the die blade upper surface 60,61. The die blade seat 72,73 is seated in a pivot recess 74,75 in a shoulder 76,77 between the die base portion 48 and die anvil 44. The shoulder 76,77 extends in a plane transverse to the die axis 6 at a level below that of the die anvil surface 46. Each die blade seat 72,73 is a major segment of a cylinder, with an axis 78,79 transverse to the longitudinal direction 10 and parallel with the cutting edges 62,63; 64,65. Each pivot recess 74,75 is a major segment of a hollow cylinder in cross-section and has an undercut 80,81 so that the die blade seat axes 78,79 are below the level of the shoulder 76,77. The part-cylindrical shape of the die blade seat 72,73 forms a matching protrusion for the pivot recess 74,75. Normal manufacturing clearances are provided between die blade seat 72,73 and pivot recess 74,75 to allow smooth pivoting movement without the need for lubricants when the die 4 is formed in M2 high speed steel. Each die blade 56,57 is therefore retained to the anvil 44 and die body 40 in the longitudinal direction 10.

Each die blade seat 72,73 and corresponding pivot recess 74,75 forms a pivot joint by which each die blade 56,57 may pivot laterally towards and away from the die anvil surface 46, respectively to constrict and dilate the die aperture 66. The die blades 56,57 are flush to 0.05 mm below the surrounding base plate 14, so that that the die blades may pivot outwards as the metal layers 7,8 are compressed by the punch tip 34 against the anvil surface. The pivot recesses 74,75 extend partially under the anvil surface 46 to facilitate the pivoting movement of the die blades 56,57.

The die blades 56,57 are biased against the die anvil 44 to constrict the die aperture 66 by a biasing means 70, seen most clearly in FIG. 3. The biasing means 70 includes an elastic portion consisting of two metal coil springs 82,83 that extend transverse to the longitudinal direction between the die blades 56,57 and two elongate rigid portions each of which is in the form of a generally cylindrical rod 84,85, and each of which is in contact with one of the die blades 56,57.

The rods 84,85 each have at their ends 86,87; 88,89 an annular groove 90,91; 92,93 into which ends 94,95; 96,97 of the coil spring are engaged. Each of the elastic portions 82,83 therefore extends between ends 86,87; 88,89 of one of the pair of rigid portions 84,85.

Each die blade 56,57 has a recess 98,99 in a surface 102,103 of the die blade that faces away from the anvil 44. The rigid rods 84,85 are seated in the recesses 98,99 to retain the biasing means around the die blades 56,57. The recesses 98,99 each have the form of a minor segment of a cylinder, matching the shape of rigid portions 76,77. This helps to minimise wear.

The coil springs 82,83 are under tension even when the die blades 56,57 are against longitudinally extending opposite sides or flanks 29 of the anvil 44. Therefore, the spring biasing means 70 serves to bias each die blade 56,57 inwards towards the flanks 29 of the anvil 44.

A small amount of clearance is provided between the coil springs 82,83 and opposite parallel sides 104,105 of the die assembly 4 formed by the die anvil 44 and die blades 56,57 in order to reduce or eliminate wear at this point.

As can be seen from FIGS. 3 and 4, because the die blades 56,57 are removable from the anvil 44 and die body 40 along a direction 110,111 transverse to the longitudinal direction 10, the biasing means 70 retains the die blades 56,57 to the anvil 44 and die body 40 along this transverse direction 110,111.

The type of joint formed by the die tool 1 is a lance type joint in which sheet material is cut along two parallel lines formed by the scissor-like contact between the die cutting edge 63,64 the punch tip 34. The clearance between each cutting edge 63,64 and the punch tip 34 is about 10% of the thickness of the combined sheet materials 6,7. Compression of the ductile sheet materials 6,7 in the longitudinal direction into the die aperture 66 and against the anvil surface 46 by the die punch tip 34 causes the sheet materials 6,7 to shear along the die blade cutting edges 63,64, and then to flow mainly in two opposite lateral directions towards each die blade 56,57. This flow causes the die blades 56,57 to be pushed outwards and the sheet materials 6,7 to flow underneath the cuts initially formed in the materials.

When the longitudinal pressure is relieved, the die punch tip 34 is withdrawn under the action of the coil spring 28 that was compressed in the drawing process. The punch tip 34 is then removed from the upper metal sheet 7, and at the same time the die 4 is removed from the lower metal sheet 8, whereupon each die blade 56,57 springs back against the die anvil 44 under the biasing action of the spring biasing means 70.

It should be noted that because the pivot joint formed by the die blade seat 72,73 and corresponding pivot recess 74,75 rotates about an axis 78,79 laterally outside the die blade inner cutting edge 63,64, when each die blade 56,57 pivots laterally outwards, each die blade upper surface 60,61 nearest the cutting edge 63,64 rises slightly at first, before falling, as the die aperture 66 opens up. The forces generated during shearing the ductile sheet material 6,7 initially tend to keep the die blades in place against the flanks 29 of the anvil 44. The die blades 56,57 therefore only rotate outwards under the influence of the expanding joint, after shearing has taken place.

The cutting action will, over time, cause wear on the cutting edges 62,63; 64,65, shown by shading along cutting edges 63 and 64 in the drawings.

As can be seen from the drawings, each die blade 56,57 is mirror symmetric about a plane extending through the die blade in the longitudinal direction 10. This plane also encompasses the pivot joint axes 78,79.

Therefore, each die blade 56,57 also has a recess 100,101 on a side opposite the recess 98,99 retaining the biasing means 70. The purpose of this feature, and the two additional cutting edges 62,65 facing away from the die anvil surface 46, is so that each die blade 56,57 can be removed from the anvil 44 and die body 40, rotated relative to the anvil surface 46 about the longitudinal direction 10, and then returned to the anvil 44 and die body 40 to present a different cutting edge 62,65 facing towards the die aperture 66 above the anvil surface 46.

All four of the recesses 98,99; 100,101 therefore serve in turn as transverse spring retention grooves along both sides of each die blade 56,57.

Figure 5:
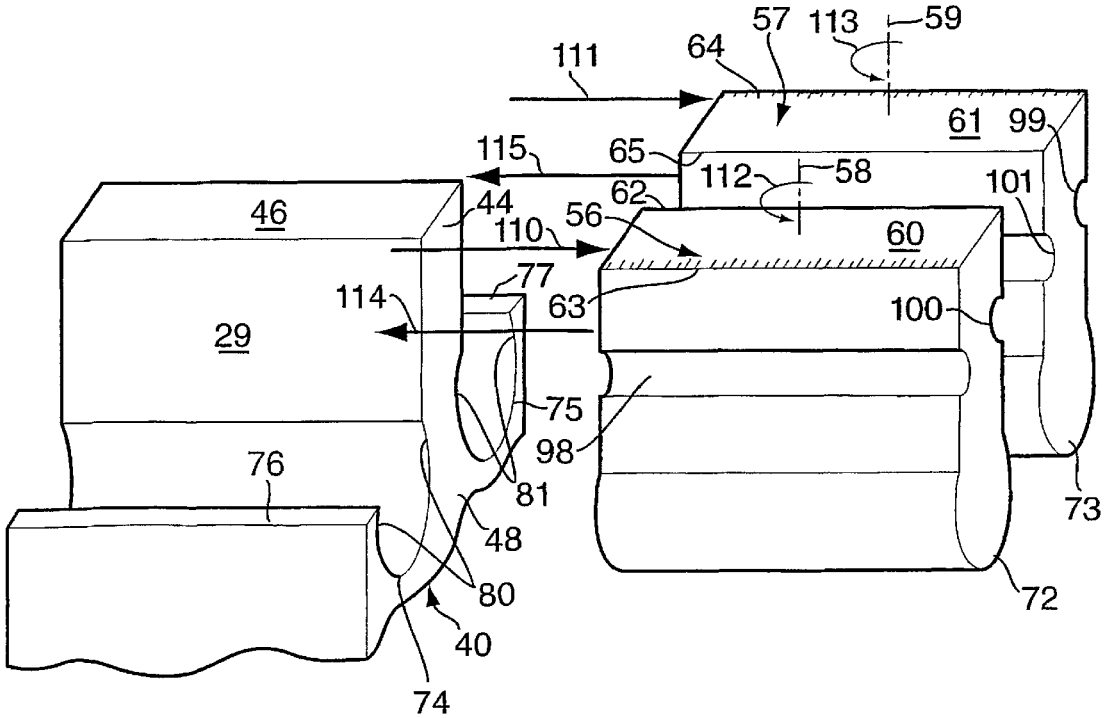
FIG. 5 is a perspective view similar to that of FIG. 4, showing one way of removing the pair of die blades and then rotating these relative to the anvil about a longitudinal direction, prior to returning the die blades to the die body to present a different, sharp cutting edge adjacent the anvil.
Figure 6:
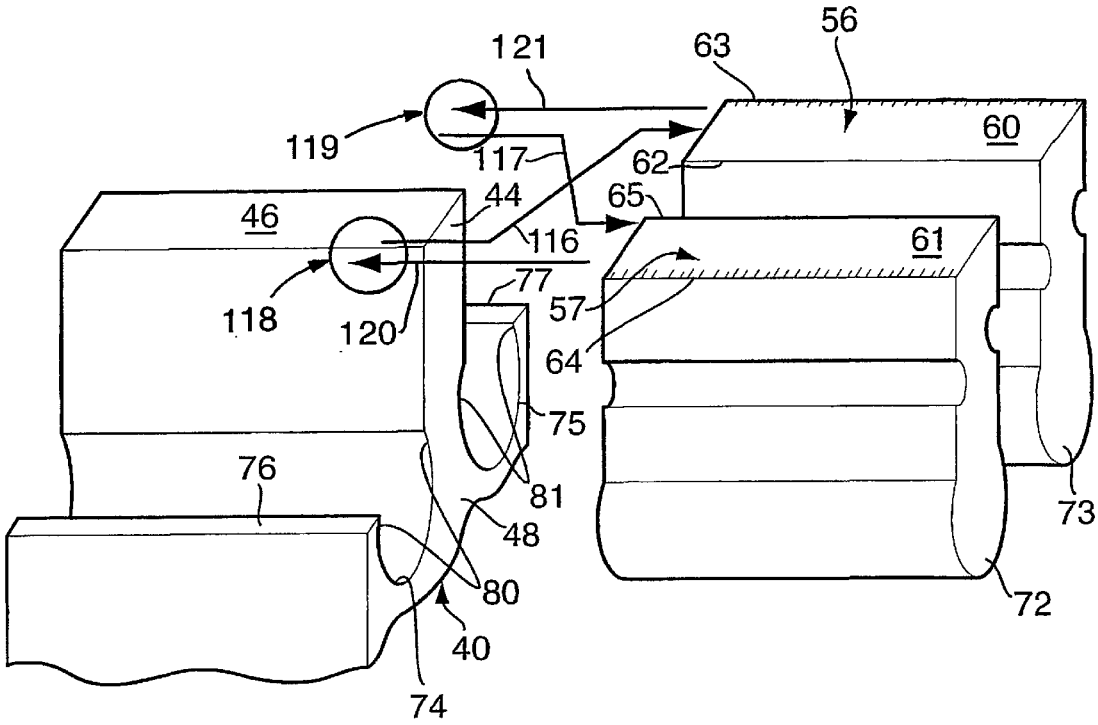
FIG. 6 shows a perspective view similar to that of FIG. 4, showing another way of removing the pair of die blades and then rotating these relative to the anvil surface about a longitudinal direction, prior to returning the die blades to the die body to present a different, sharp cutting edge adjacent the anvil.

Two ways of accomplishing this change of cutting edge 62,63;64,65 are shown in FIGS. 4, 5 and 6.

With the biasing means 70 removed from the die assembly 4, the die blades 56,57 are fitted to (or removed from) the anvil 44 and die body 40, by slotting each die blade 56,57 into (or out from) the corresponding pivot recess 74,75 along the transverse direction 110,111. One way of reversing the cutting edges relative to the anvil 44, shown in FIG. 5, is to rotate the die blades 56,57 by 180°, as shown by arrows 112,113, about the longitudinal axis of symmetry 58,59 of each die blade. The die blades are then returned 114,115 to the die body 40, retracing their path along the same transverse direction, following which the biasing means 70 is replaced to complete the die assembly 4.

Another way of reversing the cutting edges relative to the anvil 44, shown in FIG. 6, is to remove 116,117 the die blades 56,57 along the transverse direction, but then interchange 118,119 the order the die blades without actually rotating the die blades about the axes 58,59. The die blades 56,57 can then be returned 120,121 to the die body 40 with their positions interchanged 118,119, but not physically rotated. Because of the symmetry of the anvil 44, die body 40 and die blades 56,57, this interchange effectively rotates 118,119 each die blade relative to the anvil surface about the longitudinal direction 10. The biasing means 70 are then replaced to complete the die assembly 4.

The provision of two switchable cutting edges on the die blade effectively doubles the lifetime of the die blades. Because both cutting edges are at edges of the same upper surface of the die blades, both cutting edges can be formed at the same time when the die blade is manufactured. The cutting edge which is not initially used does not suffer from wear while the first cutting edge is being used, which might be the case if the second cutting edge were provided as a pivoting point or surface at the base of the die blade.

The biasing means is constructed so that contact is avoided between the relatively fragile elastic means and corners of the die, which essentially eliminates wear. The rigid portion also has a low friction contact with the die blades, ensuring smooth operation.

The invention has no need of a dedicated die shield, as die shielding is provided by the recess in the base plate, and the die blades are retained in the longitudinal direction by the pivot arrangement, and in the transverse direction by the wrap of the spring biasing means around the die blades and end flanks of the die anvil. This simplifies the manufacture and assembly of the die, and helps to minimize the lateral extent of the die assembly, making for a compact and economical die assembly.

The clinch joining tool 1 described above has a compact lateral dimension relative to the size of the joint made in sheet materials. For example, the constricted rectangular die aperture 66 may be between 4 mm to 12 mm in length (B) along a long axis, in which case the dimension of the recess 15 in the base plate 14 will be between, respectively, 8 mm to 18 mm. The width (A) of the aperture 66 between the die blades may then be between 2 mm to 8 mm. The depth (C) of the aperture will depend on the separation between the die blades and thickness of sheet material to be joined, but typically will be between 0.5 mm to 2 mm.

Modifications and substitutions by one of ordinary skill in the art are considered to be within the scope of the present invention, which is not to be limited except by the following claims.

What is claimed is:

1. A die for a ductile sheet material lance joiner, comprising:

a) a die anvil, the anvil having an anvil surface;

b) at least two die blades around the anvil, the blades extending in a longitudinal direction, generally above and below opposite sides of the anvil surface and forming with the anvil surface a die aperture for a die punch, each die blade being arranged to move away from the anvil to open up the die aperture when ductile material is forced in the longitudinal direction into the die aperture and against the anvil by a die punch, and each die blade having a cutting edge above the anvil surface and facing towards the die aperture for cutting through ductile material to make a lance joint when said ductile material is forced into the die aperture; and c) at least one biasing means by which the die blades are biased towards the anvil to constrict the die aperture;

wherein each die blade can be removed from the anvil and then returned to the anvil in such a way that each die blade is essentially rotated relative to the anvil surface about the longitudinal direction to present a different cutting edge above the anvil surface and facing towards the die aperture.

2. A die as claimed in claim 1, in which the die blades move away from the anvil to open up the die aperture by pivoting about a point below and laterally outside the anvil surface.

3. A die as claimed in claim 1, comprising for each die blade a pivot recess in the anvil, each die blade having a seat that is shaped to match the pivot recess so that when the die blade is seated in the pivot recess, each die blade can rotate outwards from the anvil to open up the die aperture when ductile material is forced in the longitudinal direction into the die aperture and against the anvil by a die punch.

4. A die as claimed in claim 3, in which the pivot recess has an undercut, and the die blade seat has a matching protrusion so that the die blade is seated in the pivot recess, the die blade is retained to the anvil in a longitudinal direction.

5. A die as claimed in claim 3, in which the pivot recess is part-cylindrical in cross-section.

6. A die as claimed in claim 1, in which there is a pair of straight and parallel cutting edges.

7. A die as claimed in claim 1, in which each die blade is mirror symmetric about a plane extending through the die blade in the longitudinal direction.

8. A die as claimed in claim 7, in which the anvil is rectangular or square with a pair of die blades on opposite sides of the anvil, and has a pair of opposite parallel sides that extend between the die blades, the biasing means extends around the die blades and said pair of opposite parallel sides.

9. A die as claimed in claim 8, in which the die blades are removable from the anvil along a direction transverse to the longitudinal direction, and the biasing means retains the die blades to the anvil along said transverse direction.

10. A die as claimed in claim 9, in which each die blade has a surface that faces away from the anvil, said surface having a recess in which a rigid portion of the biasing means is seated.

11. A die as claimed in claim 10, in which the biasing means comprises a rigid portion in the recess, and an elastic portion that extends between the die blades.

12. A die tool for lance joining two or more layers of ductile material, comprising a base plate, a recess in the base plate, and a die, the die being seated in the recess, wherein the die comprises:

a) a die anvil, the anvil having an anvil surface;

b) at least two die blades around the anvil, the blades extending in a longitudinal direction, generally above and below opposite sides of the anvil surface and forming with the anvil surface a die aperture for a die punch, each die blade being arranged to move away from the anvil to open up the die aperture when ductile material is forced in the longitudinal direction into the die aperture and against the anvil by a die punch, and each die blade having a cutting edge above the anvil surface and facing towards the die aperture for cutting through ductile material to make a lance joint when said ductile material is forced into the die aperture; and c) at least one biasing means by which the die blades are biased towards the anvil to constrict the die aperture;

wherein each die blade can be removed from the anvil and then returned to the anvil in such a way that each die blade is essentially rotated relative to the anvil surface about the longitudinal direction to present a different cutting edge above the anvil surface and facing towards the die aperture, and the recess serves as a die blade shield to limit the movement of the die blades away from the anvil.

13. A ductile material joiner for lance joining two or more layers of ductile material, comprising a punch and a die with a die aperture matching the punch, wherein the die comprises:

a) a die anvil, the anvil having an anvil surface;

b) at least two die blades around the anvil, the blades extending in a longitudinal direction, generally above and below opposite sides of the anvil surface and forming with the anvil surface a die aperture for a die punch, each die blade being arranged to move away from the anvil to open up the die aperture when ductile material is forced in the longitudinal direction into the die aperture and against the anvil by a die punch, and each die blade having a cutting edge above the anvil surface and facing towards the die aperture for cutting through ductile material to make a lance joint when said ductile material is forced into the die aperture; and c) at least one biasing means by which the die blades are biased towards the anvil to constrict the die aperture;

wherein each die blade can be removed from the anvil and then returned to the anvil in such a way that each die blade is essentially rotated relative to the anvil surface about the longitudinal direction to present a different cutting edge above the anvil surface and facing towards the die aperture.

14. A method of servicing a die for a ductile material lance joiner, the die comprising:

a) a die anvil, the anvil having an anvil surface;

b) at least two die blades around the anvil, the blades extending in a longitudinal direction, generally above and below opposite sides of the anvil surface and forming with the anvil surface a die aperture for a die punch, each die blade being arranged to move away from the anvil to open up the die aperture when ductile material is forced in the longitudinal direction into the die aperture and against the anvil by a die punch, and each die blade having a cutting edge above the anvil surface and facing towards the die aperture for cutting through ductile material to make a lance joint when said ductile material is forced into the die aperture; and c) at least one biasing means by which the die blades are biased towards the anvil to constrict the die aperture;

wherein the method comprises the steps of:

i) removing one or more of the die blades from the anvil;

ii) returning the die blade to the anvil in such a way that each removed die blade is essentially rotated relative to the anvil surface about the longitudinal direction to present a different cutting edge above the anvil surface facing towards the die aperture.

15. A method as claimed in claim 14, in which the relative rotation of the die blade relative to the anvil surface is accomplished by removing the die blade from the anvil, rotating the die blade 180° about an axis passing through the die blade in a direction parallel to the longitudinal direction, and then returning the die blade to the anvil.

16. A method as claimed in claim 14, in which the relative rotation of the die blade relative to the anvil surface is accomplished by removing a pair of opposite die blades from the anvil, and then without altering the orientation of the die blade relative to an axis passing through the die blade in a direction parallel to the longitudinal direction, returning each die blade to the anvil in the location originally occupied by the other die blade.

* * * * *